United States Patent [19]

Venieris

[11] 4,254,991

[45] Mar. 10, 1981

[54] CUSHIONED SEAT FOR POWERBOAT

[76] Inventor: George I. Venieris, 13900 Marquesas Way, Apt. D-111, Marina Del Rey, Calif. 90291

[21] Appl. No.: 6,417

[22] Filed: Jan. 25, 1979

[51] Int. Cl.[3] ..... A47C 1/00

[52] U.S. Cl. ..... 297/345; 297/311; 297/464; 297/216

[58] Field of Search ..... 297/345, 313, 284, 312, 297/311, 384, 107, 216, 454; 248/407

[56] References Cited

U.S. PATENT DOCUMENTS

| | | | |
|---|---|---|---|
| 1,200,693 | 10/1916 | Barton et al. | 248/407 |
| 1,677,213 | 7/1928 | Sanger | 297/345 X |
| 2,195,428 | 4/1940 | Searing . | |
| 2,683,482 | 7/1954 | Puls | 297/384 X |
| 3,165,355 | 1/1965 | Hitchcock et al. | 297/216 |
| 3,181,828 | 5/1965 | Cramer | 297/345 X |
| 3,231,306 | 1/1966 | Almasy | 297/345 |
| 3,420,475 | 1/1969 | Castillo et al. | 297/216 X |
| 3,446,532 | 5/1969 | Cramer | 297/313 X |
| 3,705,745 | 12/1972 | Ambrosius | 297/345 |
| 3,761,126 | 9/1973 | Mulholland | 297/384 |
| 3,773,382 | 11/1973 | Coursault et al. | 297/284 |
| 3,833,259 | 9/1974 | Pershing | 297/216 |
| 3,922,030 | 11/1975 | Stedman | 297/216 |
| 4,031,579 | 6/1977 | Larned | 297/216 X |

*Primary Examiner*—Francis K. Zugel

*Attorney, Agent, or Firm*—Nilsson, Robbins, Dalgarn, Berliner, Carson & Wurst

[57] ABSTRACT

A chair apparatus particularly useful by crew members in oceangoing powerboats has a seat assembly attached to a support flange assembly. The support flange is adjustably coupled to an upstanding support member which is fixed to a support surface to allow the seat assembly to be moved vertically along the upstanding support member. The side portions of the seat assembly are adjustable in and out to accommodate the width of a particular occupant. A posterior support extension is hinged to the front portion of the seat assembly to provide increased sitting space when, for example, the boat is not racing. The posterior support extension is rotated downward and out of the way when the boat is racing. A non-rebound impact absorption pad is attached to the interior surfaces of the seat assembly. The pad has a plurality of layers of visco-elastic foam, each layer having a different degree of firmness.

2 Claims, 3 Drawing Figures

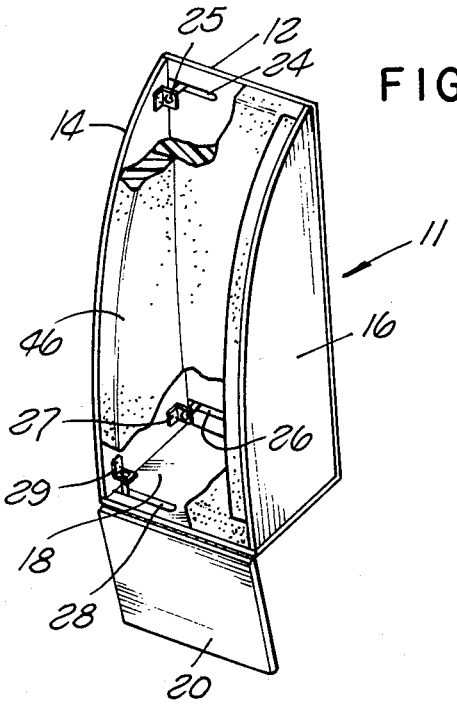
FIG. 2
FIG. 1
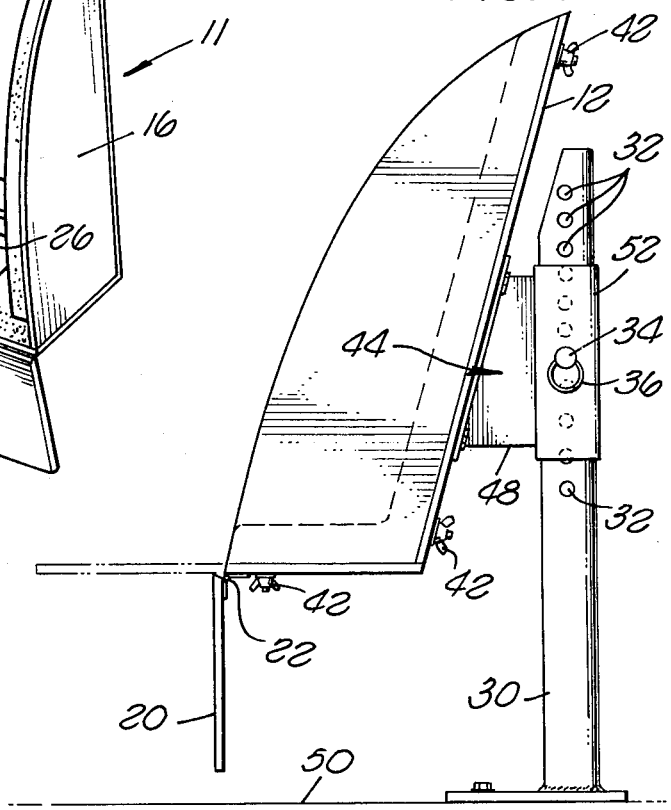
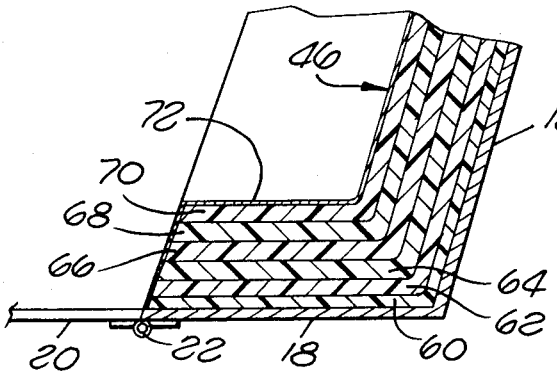
FIG. 3

CUSHIONED SEAT FOR POWERBOAT

BACKGROUND OF THE INVENTION

The present invention relates to chair apparatus and, in particular, to an adjustable, non-rebound impact absorption type chair for use in supporting a crew member of an off-shore type powerboat.

In the sport of off-shore boat racing, large, heavy boats having sufficient power to propel the boat at speeds in excess of 80 to 90 miles per hour are used. Because these boats are raced in the ocean where there are generally large swells or waves, the speed of the boats causes them to leave the water and fly through the air (sometimes being airborne for up to 10 seconds) from wave to wave or swell to swell to obtain maximum speeds. As the boat hull contacts each wave, a tremendous shock is generated because of the three-to-four ton weight of the boat. The crew of such boats (generally a three man crew) must absorb these shocks and still continue to function. Since a race typically lasts several hours, it is necessary that this continual shock due to the periodic impact of the hull against the waves be absorbed by the crew members for sustained periods of time.

The chair or seat assemblies used in off-shore racing boats at the present time consist merely of a wrap-around half cylinder type assembly which is vinyl covered polyurethane foam on a wood base member. Such a seat is provided for each crew member with the crew member standing in the region encircled by the half cylinder type seat. Such an apparatus is not truly a seat since the crew member does not sit. Rather, the device simply keeps the crew member from being violently thrown left to right and from being propelled backwardly when each shock due to the boat impacting a wave occurs. Furthermore, present seats utilized in such off-shore racing boats do not provide any adjustments to take into account the varying sizes of crew members nor do they attempt to provide any vertical cushioning or absorption of the shock. Thus, the shock is not absorbed by the seat at all. Rather, each crew member uses his knees to absorb as much of the shock as possible or alternatively, to merely bounce around. Furthermore, the forces created by the shock of impact on each wave when these off-shore racing boats are travelling at racing speeds often make it impossible for the knees and legs to fully absorb the shock.

The present invention is directed to a chair assembly which may be used by individual crew members in off-shore powerboats and in particular in off-shore racing boats. The seat of the present invention is provided with adjustable side members to permit the size of the interior, occupant support region, to be varied in size to fit the width of a particular crew member. In addition, the entire seat assembly is vertically adjustable along an upstanding support member to enable the seat to be adjusted to account for the height of the individual crew member.

In use in a racing situation, a crew member will lean or otherwise be partially supported by positioning of his buttocks against a posterior support portion of the seat. The crew member then stands with his knees partially bent and his buttocks supported by the seat or chair assembly of the present invention.

In order that the present invention provides some impact absorption without rebound of the crew member, the interior portion of the chair apparatus in which the crew member positions himself is provided with a non-rebound impact absorption pad, which comprises a plurality of layers of visco-elastic foam, such as the temper foam sold by Edmont-Wilson Company, where each layer has a different degree of firmness.

Various types of adjustable seats and cushion apparatus have been previously known. For example, in U.S. Pat. No. 4,031,579, filed Dec. 19, 1975, to Larned, a cushion is disclosed for utilization in an aircraft seat by a crew member. The cushion is laminated and includes a foam shock absorbent layer and a layer of visco-elastic foam with an outer layer designed of high porosity material to provide ventilation. However, this reference does not disclose multiple layers of visco-elastic foam as is disclosed in the present invention, wherein each layer has a degree of firmness different from that of adjoining layers. Furthermore, the Larned seat is primarily for supporting the entire weight of an occupant while the present invention is for the primary purpose of assisting in absorbing impact shocks.

In U.S. Pat. No. 3,165,355 to Hitchcock, filed July 30, 1963, an aerospace seat for use in high acceleration environments is disclosed as including a shell to which a plurality of foam layers are attached. More specifically, that patent discloses that the layer closest to the shell has the highest bulk modulus and hence the least compressibility while the layer farthest from the shell has the lowest elastic bulk modulus and, thus, the most compressibility. The middle layer then has a bulk modulus intermediate therebetween.

In U.S. Pat. No. 2,195,428 to Searing, a seat is disclosed with a hinged forward seat section which may be dropped down if desired. However, this hinged forward seat section is for the purpose of a leg rest while, in the present invention, the hinged forward seat section actually provides for seating space rather than a leg rest. This is because of the relatively narrow seating space required by the crew person in a racing environment where the seat is used not as a complete support but only as a partial support for the crew member.

Finally, in U.S. Pat. No. 3,420,475 to Castillo, et al, filed Sept. 6, 1966, a support for a seat in an aircraft provides for both vertical adjustment of the seat and impact absorption. However, this seat again is for the purpose of absorbing the entire impact and completely supports the human occupant when in use. In addition, the side members of the seat are not adjustable to provide for varying sizes of seat occupants.

SUMMARY OF THE INVENTION

The present invention is directed to a seat apparatus to be used by the crew in off-shore racing boats to permit adjustment to fit the particular size of the crew member, both as to his height and width. The seat can be used to sit in in non-racing situations or may be used for partial support and non-rebound impact absorption in racing situations. The remaining support is provided by the legs of the crew member which are slightly bent at the knees.

The non-rebound impact absorption characteristics of the seat may be obtained through utilization of a plurality of layers of visco-elastic type foam, such as temper foam. Each of the layers preferably has a differing degree of firmness from relatively soft to very hard. In one embodiment, the layer of foam immediately adjacent to the shell of the seat is extremely hard so that any residual forces created by a rather large impact will be absorbed by the foam without the crew member coming into contact with the seat shell.

A hinged forward seat section or extension is provided and may be used to sit on when the boat is not in a racing situation. However, when the boat is travelling at high speed, a posterior support extension can either be removed or allowed to pivot downward into a storage position. The posterior support extension may be locked in place during racing to keep the same from moving back and forth about the hinge pin thereby preventing injury to the legs of the operator.

A permanent, immovable posterior support portion of the seat to which the posterior support extension is attached is useful to support the lower lumbar portion of an operator. In use, the upper buttocks of the operator will rest against the posterior support portion when the seat is in a racing position with the posterior support extension rotated out of the way.

The seat assembly is supported by an upstanding support member so that the entire seat is adjustable vertically. Thus, a crew person can operate and function during a race in a standing position with his back and buttocks against the seat portion and his knees slightly flexed to accept the shock imparted as the boat impacts the waves.

The side portions of the seat are also adjustable in and out to accommodate the width of any particular crew person. The previously-described multi-layer foam pad will be affixed to the interior region about the hard shell of the seat assembly.

In a preferred embodiment, the multi-layer foam pad will be covered with a water proof layer, such as a vinyl layer. Such a layer protects the multi-layer pad from water and other environmental conditions. The multi-layers of foam are affixed to one another by any suitable means, such as gluing or a mechanical attachment means.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which:

FIG. 1 is a side plan view of the present invention showing the seat assembly adjustably mounted to an upstanding support member;

FIG. 2 is a front plan view of the seat assembly in accordance with the present invention; and FIG. 3 is a cross-section through a portion of the seat assembly illustrating the multi-layer pad in accordance with the present invention.

DETAIL DESCRIPTION

Referring first to FIG. 1, a chair apparatus 10 in accordance with the present invention is shown having an upstanding support member 30 attached to a mounting surface 50 by bolting, welding or other suitable means. A seat assembly 11 is coupled to the upstanding support member 30 by a support means 44.

In the preferred embodiment, the seat assembly is vertically adjustable relative to the mounting surface 50 so that the seat assembly 11 may be adjusted to compensate for the various heights of different human occupants. While any appropriate vertical adjustment means may be utilized, in a representative vertical adjustment means, the upstanding support member 30 may be cylindrical, having a plurality of holes 32 positioned at differing vertical distances above the mounting surface 50. The support means may comprise a support flange 48 and a hollow support cylinder 52 which is welded or otherwise attached to the support flange 48. The support cylinder 52 has an inside diameter slightly larger than the outside diameter of the upstanding support member 30 so that the support cylinder 52 fits over the cylindrical upstanding support member 30 and is freely movable up and down the upstanding support member 30. A centrally located hole is then provided through the support cylinder 52 so that the centrally located hole in the support cylinder 52 can be aligned with one of the holes 32 which extend through the upstanding support member 30. A suitable pin 34 with a pull ring 36 may then be inserted through the centrally located hole in the support cylinder 52 and a selected, aligned hole 32 of the upstanding support member 30 to hold the seat assembly 11 at a selected height. The seat assembly 11 may be adjusted upwardly or downwardly along the upstanding support member 30 by simply removing the pin 34 by pulling on the pull ring 36 and aligning a different selected hole 32 in the upstanding support member 30 with the centrally located hole in the support cylinder 52.

The seat assembly 11 may be attached to the support flange 48 in any one of a number of ways. For example, the support flange 48 may have a T-shaped cross-section where the cross member is a plate to which the seat assembly 11 may be affixed by rivets or bolts.

Referring to FIG. 2 in conjunction with FIG. 1, the seat assembly 11 comprises a shell having a back portion 12, a posterior support portion 18 which is attached along the lower edge of the back portion 12 and a pair of side members 14 and 16. The shape of the side portions generally approximates a quarter of an ellipse divided along the major and minor diameters, where the major diameter edge of each side portion is positioned adjacent to the surface of the back portion 12 and the minor diameter edge of each side member is positioned adjacent to the posterior support portion 18.

In the preferred embodiment, the respective side members of the seat assembly 11 are adjustable in and out to accommodate the differing widths of individual occupants. Adjustment of the side members 14 and 16 in and out may be accomplished in any number of ways. One illustrative method is shown in FIG. 2 wherein a bolt 25 is fixed to an angle flange which is attached by rivets, screws or the like to the interior surface of the first side member 14. A horizontal slot 24 is provided to extend through the back portion 12 of the seat assembly 11 opposite the bolt so that the bolt 25 extends through a slot 24.

A second bolt 27 may be similarly attached to the lower inside surface of the side member 14 with the bolt 27 extending through a second slot 26 in the lower region of the back portion 12. A bolt 29 may also be similarly affixed to the inside surface of the first side member 14 to extend through a third slot 28 in the posterior support portion. Wing nuts 42, as shown in FIG. 1, are then screwed onto the bolts 25, 27 and 29 extending respectively through the slots 24, 26 and 28. By loosening the wing nuts 42, the first side member 14 may be adjusted inwardly or outwardly to a selected location whereupon the wing nuts 42 may be tightened to maintain that selected position. In a similar manner, the second side member 16 may also be adjusted inwardly and outwardly.

The seat assembly 11 may also include a posterior support extension 20 which may be hinged to the forward edge of the posterior support portion 18. As previously described, the present invention is particularly useful in off-shore racing boats which are large and quite heavy. In such an application, an operator would not be entirely supported by the posterior support portion 18 during a race. Rather, the posterior support portion 18 would provide auxiliary support to the seat occupant who would be standing on the mounting surface 50 with his knees slightly bent. In such an application, the width of the posterior support portion between the front edge and the rear edge coupled to the lower portion of the back portion 12 would be too narrow to provide a comfortable seat prior to or after a race. Consequently, the posterior support extension may be provided to rotate upward into a horizontal position where it may be held by auxiliary legs or other mechanical devices well known in the art (not shown) to provide a seat for the operator. However, because the occupant must be in a semi-standing position during the race, the posterior support extension is hinged with a hinge 22 so that it may be rotated to a position which will not interfere with the operator during a race. Such a position may be a vertical position as shown in FIG. 1.

In order to provide non-rebound impact absorption for the seat, a pad 46 is provided for attachment to the interior surfaces of the seat assembly 11 defined by the back portion 12, the posterior support portion 18, and the two side members 14 and 16.

Referring to FIG. 3, the pad 46 is constructed of a plurality of layers 60 through 70 made of a special visco-elastic type foam having non-rebound characteristics. Such a foam may, for example, be "temper foam," such as that provided by Edmont-Wilson. This foam has a characteristic of being able to absorb a substantial percentage of the impact of shocks and vibration without bouncing. Thus it becomes firmer when subjected to sudden impact but deforms at the localized locations at which constant force is applied. The above-described foam material is available in varying degrees of firmness. In accordance with the present invention, therefore, each of the layers 60, 62, 64, 66, 68 and 70 are made from a visco-elastic foam material having a degree of firmness which differs from the immediately adjacent layers. In one specific embodiment, the degree of firmness of the various foam layers is provided so that the foam layer 60 has the greatest degree of firmness while the layer 70 is the softest. The intermediate layers 62, 64, 66 and 68 then have graduated degrees of firmness, with layer 62 being firmer than layer 64 and layer 64 being firmer than layer 66 and layer 66 being firmer than layer 68.

In yet another embodiment, the layer 70 may have the greatest degree of firmness and the layer 60 the least degree of firmness, with each of the layers 68, 66, 64 and 62 having increasing degrees of firmness relative to the adjacent layer nearest to the layer 70.

The foam layers may then be covered by a water proof material 72, such as vinyl or other similar material.

While the present invention has been particularly shown and described with reference to preferred embodiments, it will be understood by those skilled in the art that the foregoing and other changes in form and detail may be made without departing from the spirit and scope of the invention.

What is claimed is:

1. An impact shock absorbing lean chair apparatus mounted in an ocean-going power speed boat for mitigating impact shocks to a crew member due to impacts of the boat with ocean swells and waves, whereby the crew member leans against the lean chair in a semi-standing position, with knees slightly bent, part of each impact shock to the crew member being absorbed by the legs of the crew member and the remainder of each impact shock being absorbed by the lean chair apparatus, the lean chair apparatus comprising:

upstanding support means attached to the boat;

a seat interconnected to the upstanding support means at a vertical height selected so that the crew member will be in the semi-standing position when the crew member leans against the seat, the seat comprising:

a crew member back support portion having a lower edge;

a crew member posterior receiving portion extending outwardly from the back support portion for absorbing and mitigating ocean wave and swell impact shocks to the crew member, the posterior receiving portion having a relatively narrow width between the lower edge of the back support portion and the edge of the posterior receiving portion for providing only partial posterior support of the crew member when the crew member's back is positioned against the back support portion, the remaining impact shock absorption for the crew member being provided by the crew member's partially bent legs;

a first side member positioned adjacent to and along one side of the back support portion and the posterior receiving portion;

a second side member positioned adjacent to and along the other side of the back support portion and the posterior receiving portion, the back support portion, posterior receiving portion, the first side portion and the second side portion defining an interior surface of the seat;

a support flange interconnected between the seat and the upstanding support means for attaching the seat to the upstanding support means; and adjustment means for moving the first and second sie members relative to the back support and posterior receiving portions to vary the distance between the interior surface portions of the first and second side members, the side members interconnecting the posterior receiving portion to the back support portion at a location on the posterior receiving portion remote from the back support portion.

2. The lean chair apparatus of claim 1 further comprising chair height adjustment means interconnected between the support flange and the upstanding support member for vertically adjusting the height of the seat.

* * * * *